US007288007B2

(12) United States Patent
Wu

(10) Patent No.: US 7,288,007 B2
(45) Date of Patent: Oct. 30, 2007

(54) TYPE OF IMPROVED CONNECTING SOCKET

(75) Inventor: Ching-Li Wu, Taipei (TW)

(73) Assignee: Hsing Chau Industrial Co., Ltd. (TW)

( * ) Notice: Subject to any disclaimer, the term of this patent is extended or adjusted under 35 U.S.C. 154(b) by 0 days.

(21) Appl. No.: 11/356,579

(22) Filed: Feb. 17, 2006

(65) Prior Publication Data

US 2007/0197057 A1 Aug. 23, 2007

(51) Int. Cl.
*H01R 25/00* (2006.01)

(52) U.S. Cl. ..... 439/638; 439/76.1

(58) Field of Classification Search ..... 439/638, 439/76.1, 654

See application file for complete search history.

(56) References Cited

U.S. PATENT DOCUMENTS 4,618,196 A * 10/1986 Muzslay ..... 439/492
5,406,450 A * 4/1995 Shieh ..... 361/686
5,507,654 A * 4/1996 Daly et al. ..... 439/76.1
5,620,331 A * 4/1997 Los et al. ..... 439/404
5,836,774 A * 11/1998 Tan et al. ..... 439/76.1
5,957,728 A * 9/1999 Wu ..... 439/638
6,159,022 A * 12/2000 Tsai ..... 439/76.1
6,343,957 B1 * 2/2002 Kuo et al. ..... 439/638
6,364,713 B1 * 4/2002 Kuo ..... 439/638
6,383,028 B1 * 5/2002 Chang ..... 439/638
6,722,897 B1 * 4/2004 Wu ..... 439/76.1
6,964,585 B2 * 11/2005 Blichasz et al. ..... 439/638
2003/0148663 A1 * 8/2003 Hsin ..... 439/638
2004/0185719 A1 * 9/2004 Wang ..... 439/638
2006/0258224 A1 * 11/2006 Liao ..... 439/638

* cited by examiner

*Primary Examiner*—Gary Paumen
(74) *Attorney, Agent, or Firm*—Schmeiser, Olsen & Watts

(57) ABSTRACT

This invention relates to a type of improved connecting socket, comprising an external casing, wherein both ends have a through hole each, and a connecting unit installed at the external casing, wherein the connecting unit comprises a circuit board which has at least two connectors on it, and the sockets at the two connectors are respectively located at the two ends of the circuit board, and correspond to the through holes of the aforesaid external casing. Based on this, the connecting socket can be firmly attached to a predetermined position and serve as a socket for connecting the wire of the electronic product, and which can also be used independently as an adaptor socket for an extension wire set-up.

2 Claims, 6 Drawing Sheets

TYPE OF IMPROVED CONNECTING SOCKET

TECHNICAL FIELD

This invention relates to a type of improved connecting socket, particularly a type of plug that can enable the connecting socket to be used for plugging in the wire of an electronic product, and which can independently be used as an adaptor for extension wires.

BACKGROUND OF THE INVENTION

A When most commonly-used electrical connectors are extended to meet the requirements of users, multiple electrical connectors are stacked up together in a steel casing, and the electrical connectors are connected to a circuit board, and multiple extensions are made to the outside from the circuit board, thereby forming a multiple-layer connecting socket, which is installed on a mother board and is used for extending the connection between electronic products and computers. However, the multiple-layer connecting socket can only be used while fixed onto a motherboard, and cannot be fixed somewhere apart from the motherboard and used independently or as a connection extension for electrical products. Therefore the practical applications are limited.

Consequently, someone has designed a type of extension wire where both ends of the wire are respectively connected to an electrical connector, where the electrical connector can be a two-pin socket, a two-pin plug, a one-pin socket or a one-pin plug, such that a user who connects an electrical product and a computer is able to increase the distance between both sides, so that the electronic equipment can be placed at a suitable location. However, the extension wire is only able to extend the distance for the connection between an electronic equipment and a computer, and cannot be attached to a predetermined location for other applications.

SUMMARY OF INVENTION

The main objective of the present invention is to provide a plug that allows the connecting socket to be attached to a pre-determined location to allow the wire of electronic products to be plugged in, and at the same time can be used as an adaptor socket for an extension wire set-up.

In order to achieve the aforesaid objectives, the present invention provides a type of improved connecting socket, comprising at least two ends with a perforated external casing each, and a connecting unit that is installed within the casing, wherein the connecting unit comprises a circuit board, and the circuit board has at least two connectors, and the sockets for the connectors are located at the two ends of the circuit board, and correspond to the through holes on the external casing.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
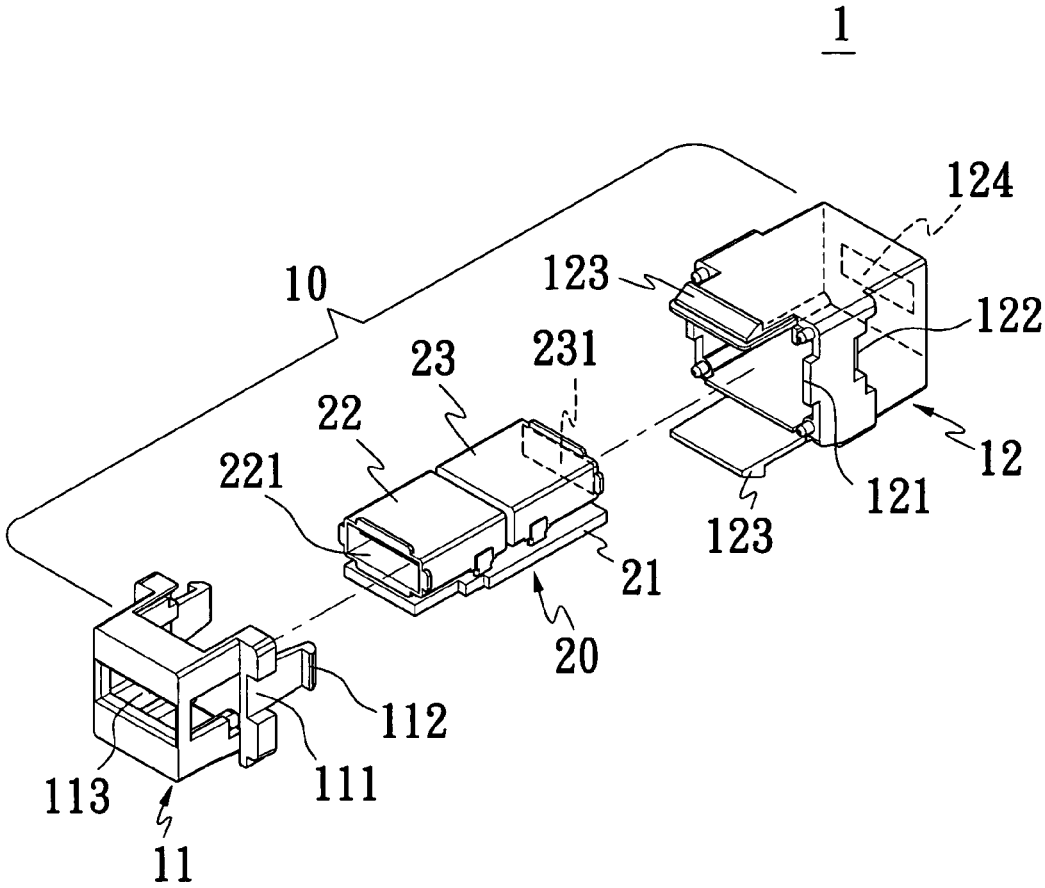
FIG. 1 refers to the exploded view of the three-dimensional schematic diagram of the present invention.
Figure 2:
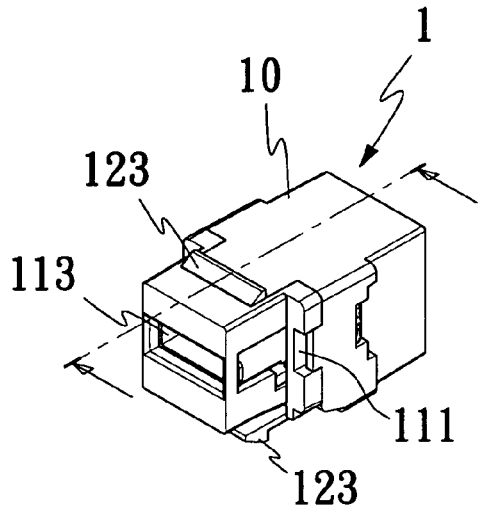
FIG. 2 refers to the external view of the three-dimensional schematic diagram of the present invention.
Figure 3:
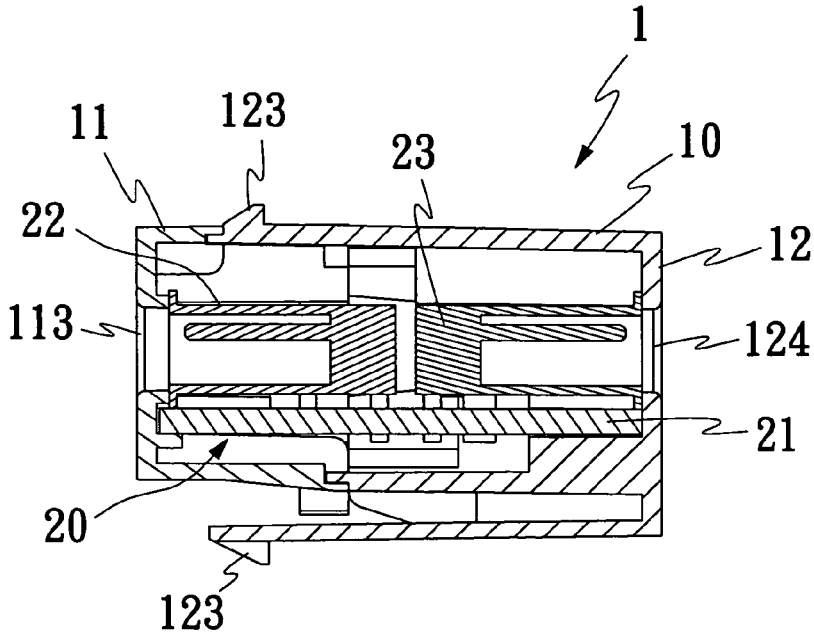
FIG. 3 refers to the schematic diagram of section a-a in FIG. 2 of the present invention.

FIG. 1 to 3 refer respectively to the exploded view of the three-dimensional schematic diagram of the present invention, the external view of the three-dimensional schematic diagram of the present invention and the schematic diagram of section a-a in FIG. 2 of the present invention. It can be seen from the aforesaid diagrams that the improved connecting socket (1) in the present invention comprises an external casing (10) and a connecting unit (20).

The aforesaid external casing (10) comprises the first casing body (11) and the second casing body (12), and the two sides of the first casing body (11) have a slot (111) each, and the ends of the slots (111) have locking hooks (112) that are extended from the ends, and the two corresponding sides of the second casing body (12) have protruding sections (121) that correspond to the slots (111), and the two sides of the second casing body (12) also have connecting holes (122) that connect to the locking hooks (112), and the two corresponding sides of the second casing body (12) have a card hook (123), and one end of the casing bodies (11 and 12) has a through hole each (113, 124).

The connecting unit (20) is installed in the external casing (10), and the connecting unit (20) has a circuit board (21), and there are at least two connectors (22, 23) on the circuit board (21), which could be USB or IEEE 1394 connectors. The plug sockets (221, 231) for the connectors (22, 23) are located at the second end of the circuit board (21), and correspond to the through holes (113, 124) at the first and second casing bodies (11, 12). The aforesaid structure constitutes an improved connecting socket.

Figure 4:
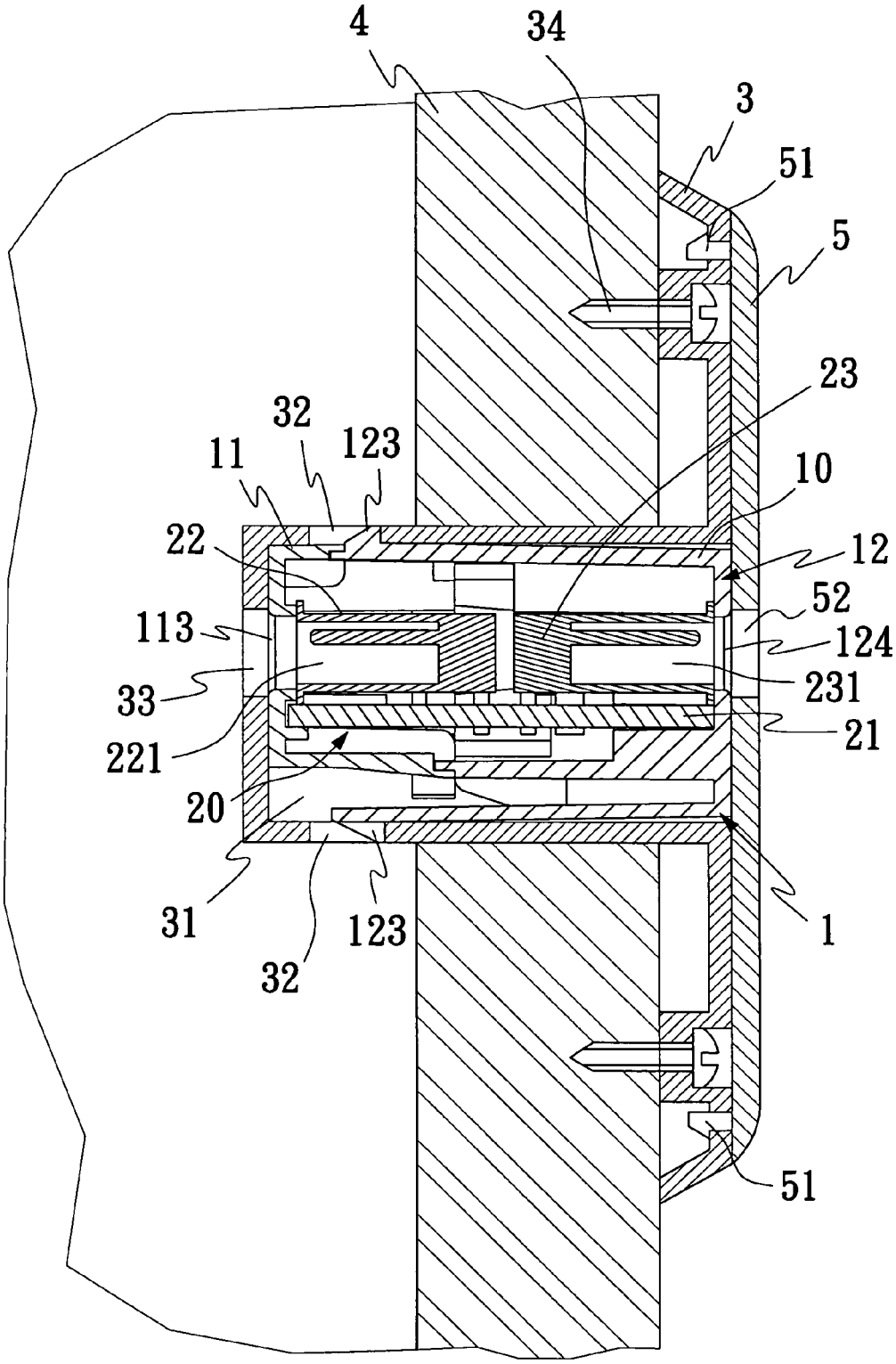
FIG. 4 refers to the schematic diagram of the operating conditions of the present invention.
Figure 5:
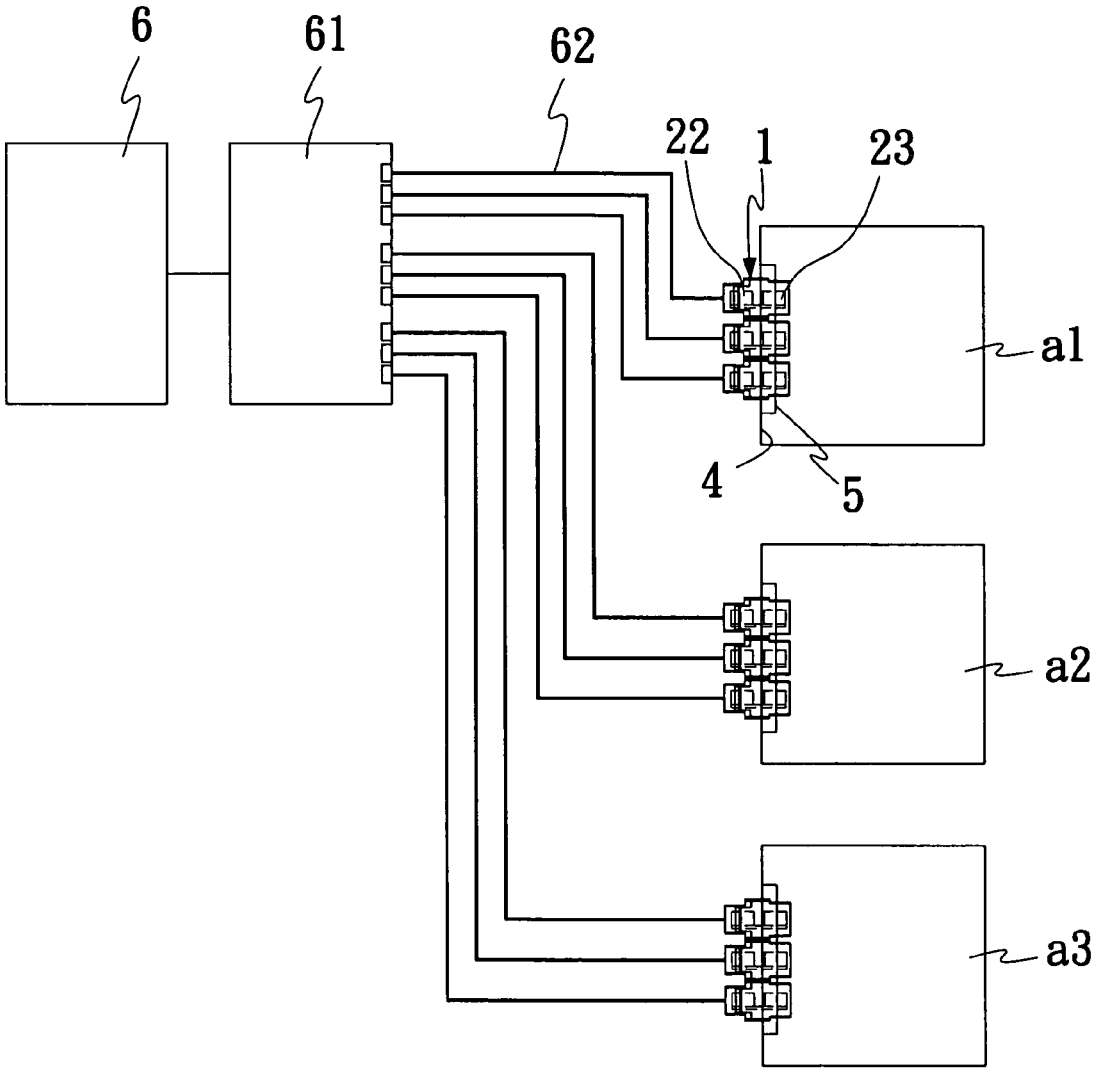
FIG. 5 refers to the schematic diagram for the methods of using the present invention.

FIGS. 4 and 5 refer to the schematic diagram of the operating conditions of the present invention and the schematic diagram for the methods of using the present invention. It can be seen from the diagram that the present invention can be firmly attached to a predetermined location to be used as a socket, and the installation should have at least a connecting socket (1) that is installed in the containment area (31) of a frame (3), enabling the connecting socket (1) to be locked into the through hole (32) at the second side of the containment area (31) by means of the card hook (123) at the external casing (10), and enabling the plug socket (221) at the connector (22) to pass through the through hole (113) at the first casing body (11) and correspond to the hole (33) at the frame (3), and the frame (3) is firmly attached to the required wall face (4) by means of a fixed component (34), and after that the face panel (5) that has a locking hook (51) is used to cover one of the faces on the frame (3), thereby enabling the plug socket (231) at the connector (23) to pass through the through hole (124) at the second casing body (12) and correspond to the hole (52) at the face panel (5). In this way, after the connecting unit (20) is installed to the external casing (10), it can be installed on the wall face (4) by means of the frame (3) and face panel (5), and the connecting unit (20) at the connecting socket (1) can be firmly fixed to a predetermined location, enabling the connectors (22, 23) to be used as sockets for connecting the wires of the electronic products.

When put into use, the aforesaid method can be used to enable multiple connecting sockets (1) to be coordinated with face panel (5) and installed at wall face (4) at the required spaces a1, a2 and a3, enabling a connector (22) of the connecting unit (20) to be installed at the external part of spaces a1, a2 and a3, and another connector (23) will be correspondingly installed at the internal part of spaces a1, a2 and a3, and a multiple transmission wire (62) is connected to the connector (22) at the connecting socket (1) at the distribution device (61) of the main server (6), thereby enabling another connector (23) in the internal part of spaces a1, a2 and a3 to connect to the electronic product, such as a mouse, keyboard, screen and other computer peripheral products.

Figure 6:
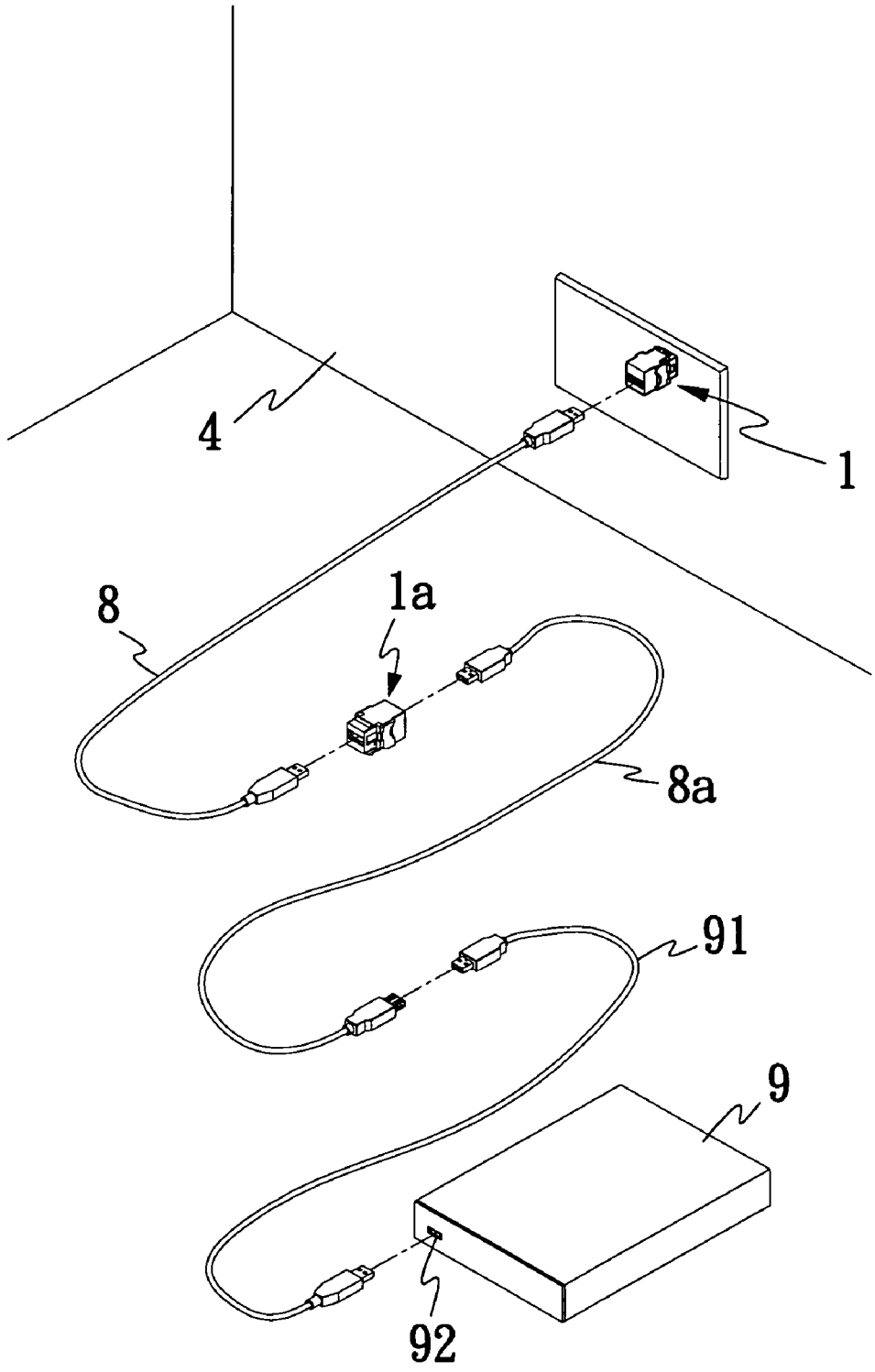
FIG. 6 refers to the schematic diagram of the alternative operating conditions of the present invention.

FIG. 6 refers to the schematic diagram of the alternative operating conditions of the present invention. It can be seen from the diagram that when the present invention is used, a connecting socket (1) can be installed at the wall face (4), and is used together with another connecting socket (1*a*) to provide the plugging connection for wires (8, 8*a*), so that the socket hole (92) of the electronic product (9) can be plugged to the connecting wire (91), and then connected to the wire (8*a*), in order to enable the connecting socket to be installed on the wall face (4), as well as enable the connecting socket (1*a*) to be used independently as the adaptor socket for the extension wires (8, 8*a*) that are required for the electronic product (9).

Figure 7:
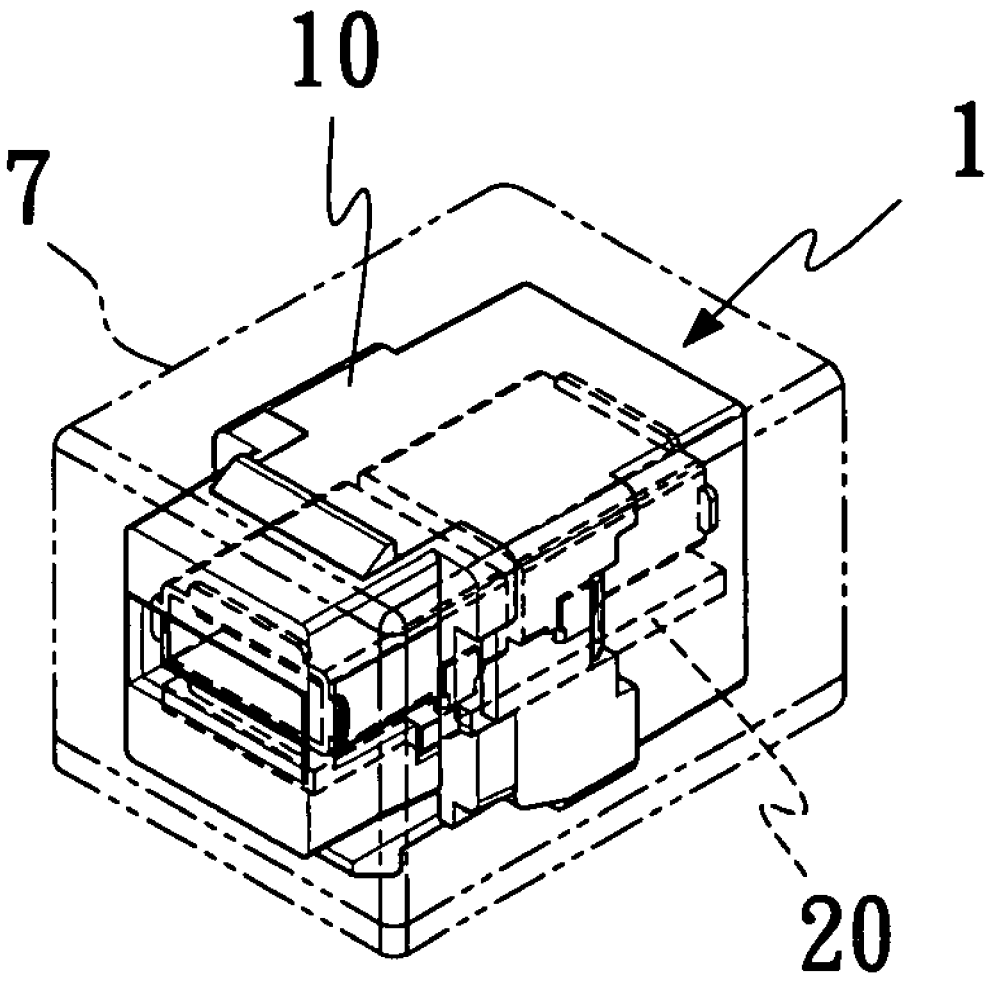
FIG. 7 refers to the external view of the three-dimensional schematic diagram of an alternative embodiment of the present invention.

FIG. 7 refers to the external view of the three-dimensional schematic diagram of an alternative embodiment of the present invention. It can be seen from the diagram that after the connecting unit (20) is installed at the external casing (10) to form a connecting socket (1), it can be further packed into a casing body (7), which not only increases the structural strength of the connecting socket (1), but also improves the overall aesthetic appearance.

Summarizing the aforesaid, the improved connecting socket in the present invention can improve the various disadvantages in the commonly-used system, and enables the connecting socket to be firmly attached to a predetermined position and serve as a socket for connecting the wire of the electronic product, and which can also be used independently as an adaptor socket for an extension wire set-up, thereby improving on the production of the present invention, and making it more applicable and suitable to the user requirements. It meets the requirement of novelty for registration as a patent, and a claim is hereby made according to the law to patent the invention.

The aforesaid are merely the preferred embodiments in the present invention, and do not limit the scope of the embodiments for the present invention. Anybody who makes any changes or adjustments to the present invention based on the scope of the patent claim and the disclosure of the invention must keep within the scope laid out in the patent.

I claim:

1. A type of improved connecting socket, comprising:

an external casing, wherein both ends have a through hole thereof, wherein said external casing comprises a first casing body and a second casing body and further, wherein the two sides of the first casing body each have a slot and locking hooks extend from the ends of said slots; and a connecting unit installed in the external casing; wherein the connecting unit comprises a circuit board which has at lest two connectors on one planar face thereof, and the sockets of the two connectors are respectively located at two ends of the circuit board, and correspond to the through holes of said external casing.

2. A type of improved connecting socket, comprising:

an external casing, wherein both ends have a through hole thereof, wherein said external casing comprises a first casing body and a second casing body and further, wherein the two sides of the first casing body each have a slot and locking hooks extend from the ends of said slots;

a connecting unit installed in the external casing; wherein the connecting unit comprises a circuit board which has at lest two connectors on one planar face thereof, and the sockets of the two connectors are respectively located at two ends of the circuit board, and correspond to the through holes of said external casing; and wherein two corresponding sides of the second casing body have protruding sections and connecting holes that correspond to said slots and said locking hooks of the first casing body, respectively, and there are card hooks at the ends of two corresponding sides of the second casing body.

* * * * *